US011231144B2

(12) United States Patent
Lose et al.

(10) Patent No.: US 11,231,144 B2
(45) Date of Patent: Jan. 25, 2022

(54) METHODS FOR HELIUM STORAGE AND SUPPLY

(71) Applicant: Messer industries USA, Inc., Bridgewater, NJ (US)

(72) Inventors: Niels Lose, Starnberg (DE); Nicholas Haines, Bedminster, NJ (US)

(73) Assignee: MESSER INDUSTRIES USA, INC., Wilmington, DE (US)

( * ) Notice: Subject to any disclaimer, the term of this patent is extended or adjusted under 35 U.S.C. 154(b) by 0 days.

(21) Appl. No.: 15/963,496

(22) Filed: Apr. 26, 2018

(65) Prior Publication Data

US 2019/0331299 A1 Oct. 31, 2019

(51) Int. Cl.

| | |
|---|---|
| ***F17C 5/06*** | (2006.01) |
| ***F17C 9/02*** | (2006.01) |
| ***F17C 5/04*** | (2006.01) |
| ***F17C 13/02*** | (2006.01) |

(52) U.S. Cl.

CPC ..... *F17C 5/06* (2013.01); *F17C 9/02* (2013.01); *F17C 13/023* (2013.01); *F17C 13/025* (2013.01); *F17C 13/026* (2013.01); *F17C 5/04* (2013.01); *F17C 2221/017* (2013.01); *F17C 2223/013* (2013.01); *F17C 2225/0123* (2013.01); *F17C 2250/032* (2013.01); *F17C 2250/036* (2013.01); *F17C 2250/0421* (2013.01); *F17C 2270/05* (2013.01)

(58) Field of Classification Search

CPC ..... F17C 5/04; F17C 2221/017; F17C 2250/0421; F17C 9/02; F17C 13/028; F17C 5/06; F17C 13/023; F17C 13/025; F17C 13/0265; F17C 2225/0123; F17C 2223/013; F17C 2250/032; F17C 2250/036; F28F 2215/10

See application file for complete search history.

(56) References Cited

U.S. PATENT DOCUMENTS

| | | | | |
|---|---|---|---|---|
| 4,766,731 | A * | 8/1988 | Graczyk | F17C 9/02 62/50.2 |
| 4,788,648 | A * | 11/1988 | Ferretti | G01F 23/16 340/618 |
| 5,386,707 | A * | 2/1995 | Schulte | F17C 9/00 62/50.2 |
| 6,178,755 | B1 | 1/2001 | Castellanet | |
| 7,621,302 | B2 * | 11/2009 | Shock | F17C 5/06 141/104 |
| 9,334,859 | B2 | 5/2016 | Dresens et al. | |

(Continued)

OTHER PUBLICATIONS

International Search Report in PCT/US19/29434 dated Aug. 6, 2019 (pp. 1-3).

*Primary Examiner* — Paul Alvare

(74) *Attorney, Agent, or Firm* — Joshua L. Cohen

(57) ABSTRACT

A method for supplying helium to at least one end user is disclosed by feeding helium from at least one container of helium to an end user through at least one supply system, wherein a mass flow meter and a pressure transmitter, in electronic communication with a programmable logic controller measures an amount of helium being supplied to the at least one user, provides the amount to the programmable logic controller which provides a signal to the at least one end user of an amount of helium that remains in the at least one container and the temperature therein.

9 Claims, 3 Drawing Sheets

(56) References Cited

U.S. PATENT DOCUMENTS

| | | | | |
|---|---|---|---|---|
| 9,671,159 | B2 | 6/2017 | Diederichs et al. | |
| 2006/0238346 | A1* | 10/2006 | Teller | B67D 3/0077 340/572.1 |
| 2007/0169837 | A1* | 7/2007 | Cohen | B01F 3/028 141/102 |
| 2010/0018249 | A1* | 1/2010 | Burgers | F17C 5/06 62/657 |
| 2011/0312502 | A1* | 12/2011 | Lose | G01R 33/3804 505/310 |
| 2014/0053576 | A1 | 2/2014 | Lose et al. | |
| 2014/0174593 | A1* | 6/2014 | Ammouri | F17C 5/007 141/4 |
| 2016/0097666 | A1* | 4/2016 | Wise | G01F 15/0755 702/55 |
| 2016/0245426 | A1* | 8/2016 | Fowler | F16K 37/0041 |
| 2018/0327243 | A1* | 11/2018 | Rider | B67D 1/0004 |

* cited by examiner

METHODS FOR HELIUM STORAGE AND SUPPLY

BACKGROUND OF THE INVENTION

Helium is mostly delivered to users in its gaseous state in cylinders such as cylinder packs (MCP's) or in tube trailers (TT). For some uses though, it may be beneficial to have the helium supplied directly in liquid helium ISO containers similar to those used for global transportation of liquid helium, or cold supercritical helium gas, from the helium sources to the helium transfill plants.

Such users typically have a high helium consumption for applications such as air bag inflation, fiber optic production, chemical vapor deposition, mechanical surface coating, rocket purging, or they may require a high purity supply for microelectronics wafer production which is typically achieved from a liquid helium ISO container rather than a gaseous helium supply mode.

To facilitate the supply of helium from the ISO containers to the user's process, a dedicated supply process must be installed in or near the user's premises. A disadvantage with respect to using ISO containers is the ability to measure or predict their temperature. Direct measurements are not possible and downstream measurements are considered inaccurate because of potential leak of heat into the ISO system.

A helium user would need to install permanent weighbridges on the ISO containers. Alternatively, the helium user would need to transport the ISO containers to external weighbridges for determining the precise amount of their contents.

Further, the helium user would need to perform liquid nitrogen top up of the liquid nitrogen shield prior to those weighing measurements.

A helium user could rely on the relatively inaccurate level indicator installed in an ISO container. This is not continuous on-line monitoring of the contents of an ISO container, so the helium user would not know the amount of helium or the temperature of the ISO container in real time.

This may also create the disadvantages of generating "warm" ISO containers which may lead to increased emissions of gaseous impurities from the ISO containers and may lead to container cool down fee applied by the helium source when the owner has the ISO containers refilled.

Not having a real time reading also impacts the optimization made available by the addition of helium pressurization gas to the ISO containers.

The present inventors have discovered a method of supplying helium from ISO containers to a customer for a customer's on-site usage of the helium that overcomes these problems.

SUMMARY OF THE INVENTION

In a first embodiment of the invention, there is disclosed a method for supplying helium to at least one end user comprising:

feeding helium from at least one container of helium to an end user through at least one supply system, wherein a mass flow meter, in electronic communication with a programmable logic controller measures an amount of helium being supplied to the at least one user, provides the amount to the programmable logic controller which provides a signal to the at least one end user of an amount of helium that remains in the at least one container.

The at least one end user is selected from the group of air bag inflation, fiber optic production, chemical vapor deposition, mechanical surface coating, rocket purging and microelectronics wafer production, lifting applications, leak detection applications, welding applications, medical applications, and breathing applications.

The at least one container can be an ISO container, preferably two ISO containers.

The supply system comprises at least one pipe in communication with the at least one container and at least one user, and can have an automatic process control valve present therein A weight of the at least one container of helium is measured before supplying the helium. The initial weight of the at least one container is measured and provided to the programmable logic controller.

The at least one mass flow meter measures the mass flow of helium from the at least one container. Typically, the mass flow meter can be a Coriolis mass flow meter.

The pressure of the helium in the at least one supply system is measured by at least one pressure transmitter.

The method can further incorporate an alarm which alerts the at least one user in the event that a pre-calculated value is exceeded in the at least one container. The pre-calculated value is selected from the group consisting of mass, temperature and pressure. Typically, this pre-calculated value is the amount of helium dispensed from the at least one container. The alarm would alert the at least one end user that there is a minimum volume of helium remaining in the at least one container so that the at least one end user could begin appropriate corrective measures.

The programmable logic controller is further in electronic communication with the at least one pressure transmitter. The programmable logic controller calculates the temperature of the at least one container through calculations based on information received from the at least one mass flow meter and at least one pressure transmitter.

The programmable logic controller is in electronic communication with a pressurization gas system. The programmable logic controller instructs the pressurization gas system to feed additional helium gas to the at least one container, thereby to control the temperature of the at least one container.

The amount of helium that remains in the at least one container can be used to calculate an amount of money owed by the at least one end user and this amount is sent to a supplier of the helium. The supplier of the helium can then prepare a bill to send to the at least one end user for the amount of money owed by the at least one end user.

In another embodiment of the invention, there is disclosed a method for measuring the flow of helium to at least one user comprising feeding helium from at least one container of helium to the at least one end user, through at least one supply system, wherein at least one mass flowmeter in communication with a programmable logic control measures the flow of helium to the at least one end user.

In a further embodiment of the invention, there is disclosed a method for controlling helium supply to at least one user comprising:

Feeding helium from at least one container of helium to the at least one end user, through at least one supply system;

Wherein at least one mass flow meter in communication with a programmable logic control measures the flow of helium to the at least one end user

DETAILED DESCRIPTION OF THE INVENTION

Figure 1:
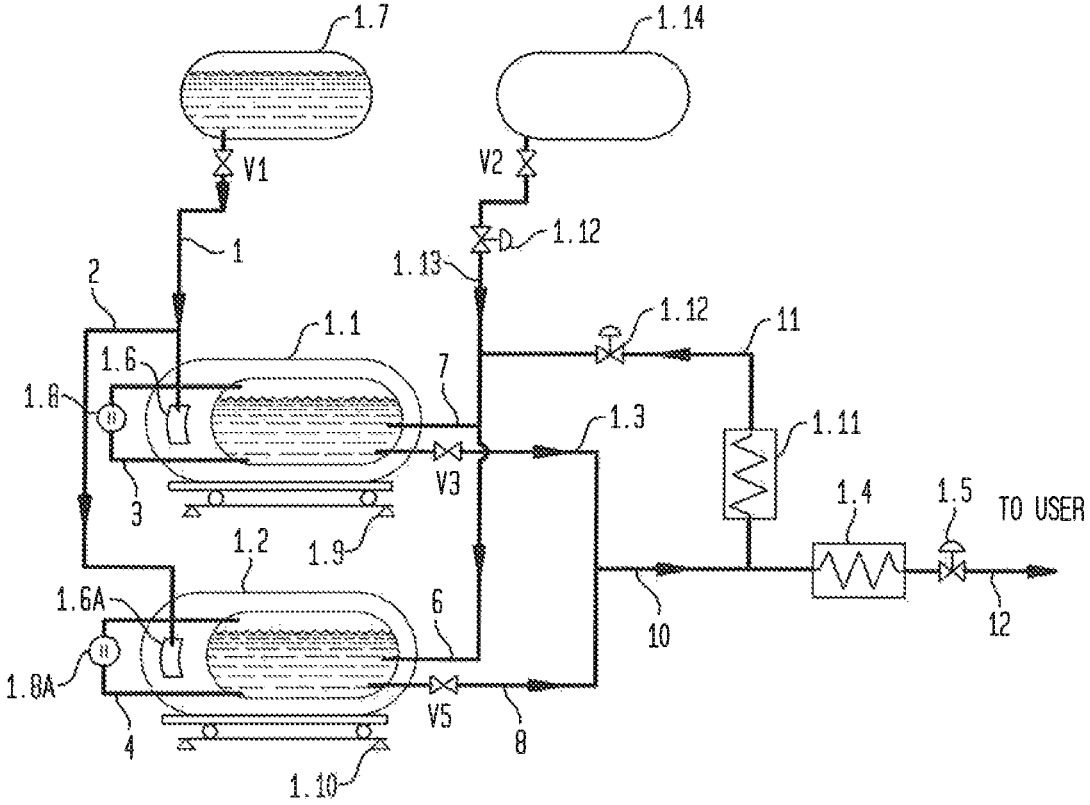
FIG. 1 (PRIOR ART)
FIG. 1 is a schematic representation of a prior art helium supply process.

The prior art process of supplying helium from an ISO container is shown in FIG. 1. helium is supplied to the users' premises in an ISO container 1.1 either in a 2 phase liquid/gas state or in a supercritical state if the temperature of the ISO container is above the critical temperature 5.2K.

A second ISO container 1.2 may be installed. Typically, the water volume of the ISO containers ranges from 3,400 gallons to 15,000 gallons. The helium is fed from the ISO container through a pipework that may be vacuum jacketed 1.3 such as line 8, through a heater 1.4 through line 10 and a pressure control valve 1.5 to user's process through line 12.

The ISO container if greater than 3,400 gallons in size will be equipped with internal liquid nitrogen (LIN) shields 1.6 and 1.6A which frequently on the order of 10 to 45 days should be replenished with liquid nitrogen for reduction and control of the heat that may leak in from ambient atmospheric temperature to the ISO containers. The liquid nitrogen is supplied from tank 1.7 through valve V1 and line 1 to the shield 1.6 in ISO container 1.1 and line 2 to shield 1.6A in ISO container 1.2. The tank 1.7 can be stationary or mobile. Alternatively, the ISO container's LIN shield may be filled from a mobile LIN dewar.

The ISO containers are equipped with mechanical level indicators 1.8 and 1.8A which through lines 3 and 4 respectively will measure the differential pressure between the top and the bottom of the ISO containers' inner vessel. Due to the various pressure and temperature conditions inside the ISO containers during operation, the particularly low density of liquid helium, and the low geometrical height of the inner vessel of the ISO containers, this method of level indication is relatively inaccurate and only intended for rough approximations.

The ISO containers 1.1 and 1.2 may be located on stationary weighbridges 1.9 and 1.10 which can be used for accurate measurements of the contents of the ISO containers. However, an accurate measurement of both the full and residual contents of the ISO containers requires that the liquid nitrogen shield is filled prior to taking the measurement. Alternatively, the weight of the residual content can be measured on an external weighbridge which is not shown. This will require then that the ISO containers be disconnected from the system and transported to and from the external weighbridge which will require time and generate costs. Further the ISO containers so disconnected must be filled with LIN prior to their weight being measured and prior to being refilled with liquid helium at the source.

During their utilization the pressure of the ISO containers must be controlled to a desired value depending on the user's requirements. Typically, this pressure ranges from 4 to 175 psig.

This is typically accomplished by adding helium pressurization gas (PG) at ambient temperature into the ISO containers.

The pressurization gas can be supplied through an internal pressure build up system which comprises a heat exchanger 1.11 which is exposed to ambient air conditions and a pressure control valve 1.12. This system may be an integral part of the ISO container(s) or it can be installed downstream of the ISO container(s).

Alternatively, the helium pressurization gas can be supplied from an external gaseous helium source 1.14 which can be a tank or other storage device of a mobile or stationary nature. This helium pressurization gas would flow through line 1.13 and open valve V2 and pressure regulator 1.12 before connecting with ISO containers 1.1 and 1.2 through lines 7 and 6 respectively.

During the utilization of the ISO container(s) 1.1 and 1.2, the addition of the helium pressurization gas will inevitably cause the temperature of the ISO container(s) to rise. This increase in temperature combined with the low content in the ISO containers will increase the emission of gaseous impurities from the ISO container(s). This is a particularly undesired result as many helium users require a high purity supply and the added cost in further purifying the helium can be prohibitive. Moreover, a warm container typically greater than 20 K may cause a cool down fee to be applied at the helium source when the empty or nearly empty ISO container(s) are returned to their source for refilling.

Subsequently, in many instances, the ability to measure or predict the temperature of the ISO container(s) becomes important. However, as the ISO containers are not equipped with a thermometer (or a thermowell) direct measurements of the temperature of the ISO container(s) are not possible and direct temperature measurements downstream of the ISO container(s) are generally considered to be inaccurate because of heat in-leak into the system.

Figure 2:
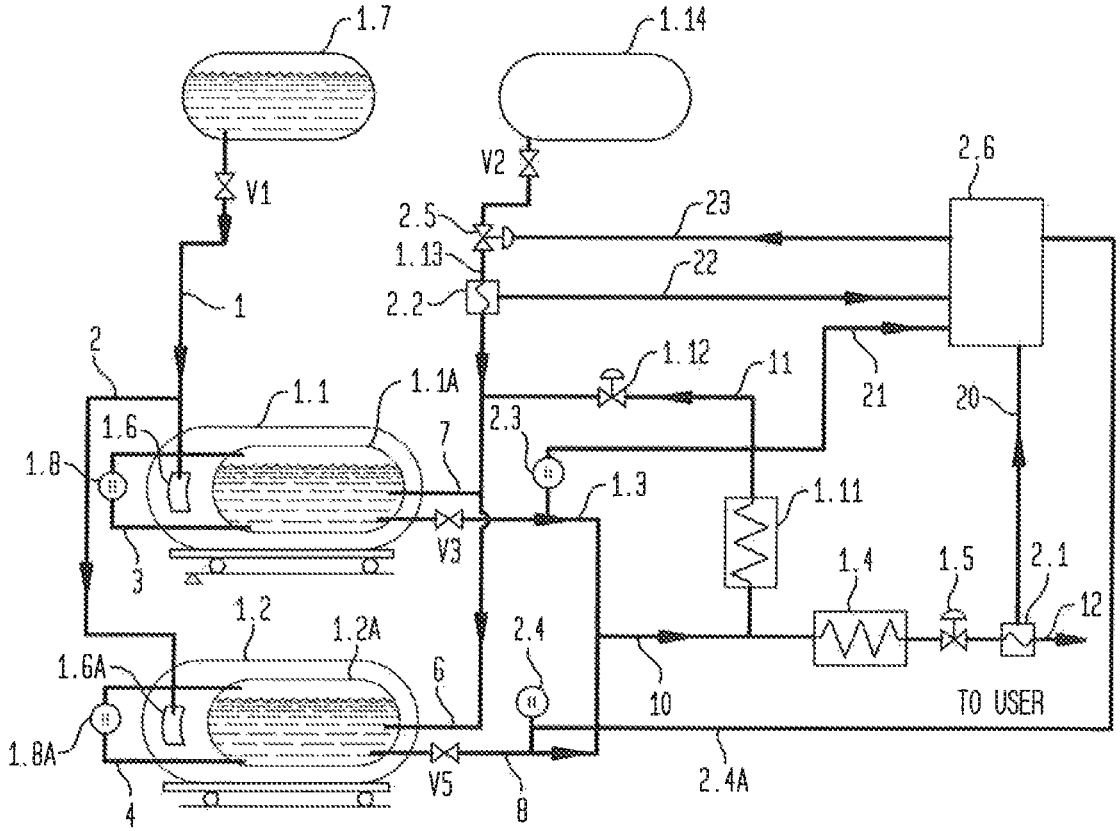
FIG. 2 is a schematic representation of a helium supply process according to the methods of the invention.

For purposes of describing the invention, like components, lines, etc. will bear the same numbering configuration in FIG. 1 and FIG. 2.

FIG. 2 is a schematic of a helium delivery system according to the invention.

Two ISO containers 1.1 and 1.2 are designed to deliver helium to an on-site user of helium.

The inventive process no longer employs weighbridges and incorporates mass flow meters and pressure transmitters into the system. Further the pressure regulator 1.12 in FIG. 1 has been replaced by an automatic process control valve.

A programmable logic control is integrated with the mass flow meters, the pressure transmitters and the process control valve.

Prior to the system operation, the mass of a full ISO container is recorded in the programmable logic controller. During system operation, the programmable logic controller receives an analogue signal from the mass flow meters which allows the programmable logic controller to calculate the residual mass in the ISO container independent of a 100 percent replenished liquid nitrogen shield.

When a pre-determined low residual content in the ISO container has been reached, the user is notified by the programmable logic controller and the flow rate of helium adjusted and/or the ISO container is turned off.

As the residual mass of helium in the ISO containers is known at any time, the programmable logic controller can be programmed to calculate the actual density of the helium in the containers at any time by dividing the residual mass by the temperature compensated water volume of the inner vessel of the ISO containers.

By combining this information about the density of the helium inside the ISO containers with the pressure of the ISO containers as measured by the pressure transmitters, the programmable logic controller can be programmed to calculate the corresponding temperature of the ISO containers. This algorithm can be based on thermophysical properties for helium gas as reported by databases such as NIST or REFPROP, and detailed more below with respect to FIG. 3.

The programmable logic controller can be programed to alert the user through an alarm system or shutdown/switch over the ISO containers if an undesired high temperature of an ISO container is reported.

By combining the information about the actual residual mass, the pressure and temperature of the ISO containers, the programmable logic controller can be programmed to control the addition of the pressurization gas via a process control valve to be optimized by a feedback or a cascade control loop for example. This can inhibit overdosing of heat energy into the ISO containers by taking into account such variables for example as the response time for pressure increase or decrease in the ISO containers versus, the actual pressure increase or decrease rate.

A minimized heat input to the ISO containers will reduce the risk of generating "warm" ISO containers which empirically are known for generating an excessive emission of gaseous impurities into the helium gas to the user. Further the minimized heat input will reduce the risk of generating an ISO container pressure higher than the maximum allowable working pressure of the ISO containers that may lead to activating the pressure safety devices of the ISO container which could lead to further losses of helium.

As noted with respect to FIG. 1, the water volume of the ISO containers ranges from 3,400 gallons to 15,000 gallons. The helium is fed from the ISO container through a pipework that may be vacuum jacketed 1.3 such as line 8, through a heater 1.4 through line 10 and a pressure control valve 1.5 to user's process through line 12.

The ISO container if above 3,400 gallons in size will be equipped with an internal liquid nitrogen (LIN) shield 1.6 and 1.6A for ISO containers 1.1 and 1.2 respectively which frequently on the order of 10 to 45 days should be replenished with liquid nitrogen for reduction and control of the heat that may leak in from ambient atmospheric temperature to the ISO containers. The liquid nitrogen is supplied from a tank 1.7 through valve open control V1 and line 1 to the shield 1.6 in ISO container 1.1 and line 2 to shield 1.6A in ISO container 1.2. The tank 1.7 can be stationary or mobile.

The ISO containers are equipped with mechanical level indicators 1.8 and 1.8A which through lines 3 and 4 respectively will measure the differential pressure between the top and the bottom of the ISO containers' inner vessel 1.1A and 1.2A respectively for ISO containers 1.1 and 1.2. Due to the various pressure and temperature conditions inside the ISO containers during operation, and the low geometrical height of the inner vessel of the ISO containers, this level indication is relatively inaccurate and only intended for rough approximations.

During their utilization the pressure of the ISO containers must be controlled to a desired value depending on the user's requirements. Typically, this pressure ranges from 4 to 175 psig.

This is typically accomplished by adding helium pressurization gas (PG) with ambient temperature into the ISO containers.

The pressurization gas can be supplied through an internal pressure build up system which comprises a heat exchanger 1.11 which is exposed to ambient air conditions and a pressure control valve 1.12. This system may be an integral part of the ISO container(s) 1.1 and 1.2 or it can be installed downstream of the ISO container(s) 1.1 and 1.2.

Alternatively, the helium pressurization gas can be supplied from an external gaseous helium source 1.14 which can be a tank or other storage device of a mobile or stationary nature. This helium pressurization gas would flow through line 1.13 and open valve V2 and pressure regulator 1.12 before connecting with ISO containers 1.1 and 1.2 through lines 7 and 6 respectively.

The helium flowing from ISO container 1.2 passes through a pressure measuring and transmitting device 2.4 before being fed through line 8 into heater 1.4. Likewise, the helium withdrawn from ISO container 1.1 is directed through a pressure measuring and transmitting device 2.3. The pressure measuring and transmitting device 2.3 is in electronic communication with the PLC 2.6 through signal cable 21. Likewise, the pressure transmitting device 2.4 is in electronic communication with the PLC 2.6 through signal cable 2.4A.

The programmable logic controller 2.6 is in electronic communication with mass flow meters 2.1 and 2.2 as well as pressure transmitters 2.3 and 2.4 and process control valve 2.5 in that the PLC will receive signals from these devices providing information with respect to the supply of helium to an end user, the content of helium in ISO container 1.1 and 1.2 and the temperature of ISO container 1.1 and 1.2.

The mass flow metering device is designed to measure and monitor the flow of the helium in the system. By measuring the temperature and pressure of the helium at various places in the system, this data can be forwarded a programmable logic controller which can adjust valves, openings, etc. to change the helium flow rate to meet the system and user's needs.

A portion of the helium being fed to the user through open process flow controller 1.5 is fed through a mass flow meter 2.1 which communicates with PLC 2.6 through signal cable 20.

The PLC 2.6 is in communication with process control valve 2.5 through signal cable 23 which will combine the helium coming from the external gaseous source 1.14 with the helium in the ISO containers 1.1 and 1.2. The process control valve 2.5 will work to direct the appropriate flow rate of helium to ISO containers 1.1 and 1.2 and maintain the desired pressure in them. The flow of external gaseous helium is fed through mass flow meter 2.2 which is in electronic communication with the PLC 2.6 through signal cable 22 allowing the PLC 2.6 to calculate the residual content in ISO containers 1.1 and 1.2 at any time.

Additionally, the PLC 2.6 can through its electronic communication with mass flow meter 2.2 measure the cumulative consumption of external gaseous helium used for pressurization of the ISO containers 1.1 and 1.2. This will allow the PLC 2.6 to calculate the residual content of the external gaseous source at any time and inform the users in advance of when a new external gaseous helium source must be installed.

By measuring the mass flow of the helium through the system, weighbridges can be eliminated from the system as well as the costs associated with their installation, roofing etc.

Further, there is no need to move the ISO containers now to measure their weight so costs savings are realized as well. A continuous "on-line" measurement of the content of the ISO containers will eliminate the need for liquid nitrogen top up, taking into consideration the amount of time the ISO container is in place and exceeds the permissive amount of time between LIN fills. Thus the use of mass flow meters along with temperature and pressure measurements allows for calculation of the amounts of helium in the ISO containers to be accurately measured.

Additionally, as the physical conditions of the ISO containers such as density, pressure and temperature can be measured, the actual mass withdrawal can be known at any time. Therefore, a feed backward control loop and control valve can optimize the dosing of the external helium pressurization gas thereby minimizing the undesired temperature rise of the ISO containers.

The precise monitoring of conditions allows the user to predict when the next ISO container needs to be supplied and can act accordingly. Likewise, these measurements can assist the supplier of helium with their billing operations.

Figure 3:
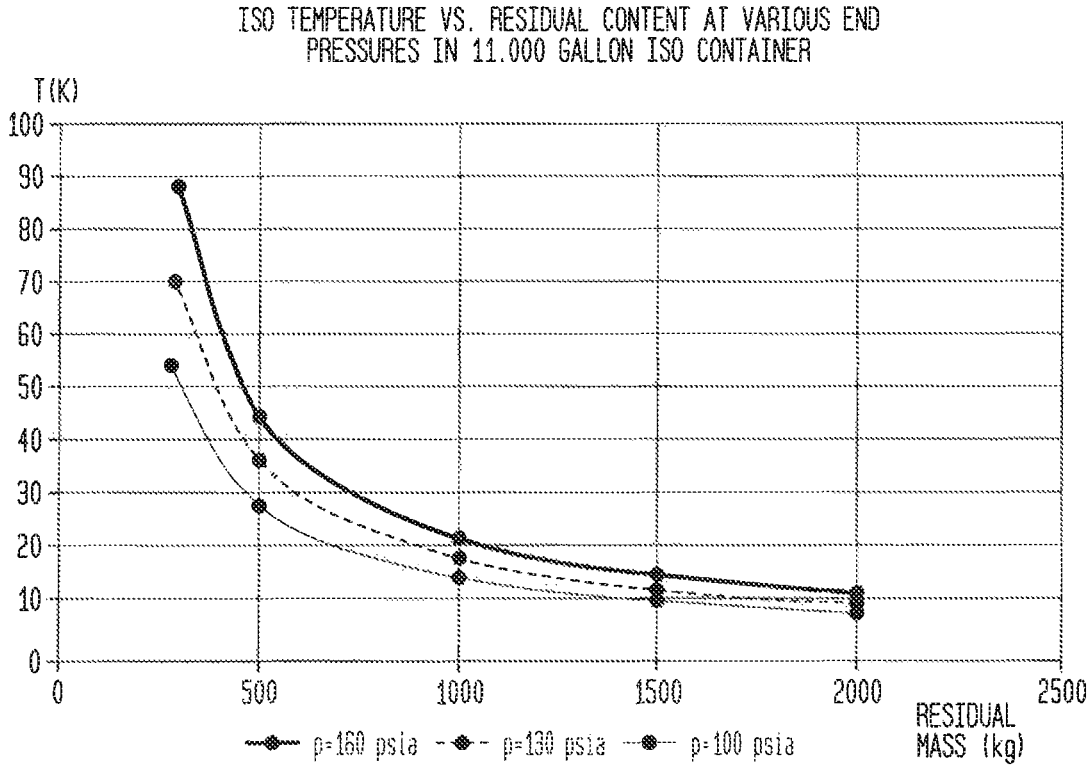
FIG. 3 is a graph showing the temperature of an ISO container versus the residual mass of helium at various pressures.

FIG. 3 is a graph showing the temperature of an 11,000 gallon ISO container versus the residual mass of helium in the ISO container at three different pressures of 160 psia, 130 psia and 100 psia. It can be seen that the temperature of the ISO container increases as the amount of helium is reduced through being dispensed from the ISO container.

While this invention has been described with respect to particular embodiments thereof, it is apparent that numerous other forms and modifications of the invention will be obvious to those skilled in the art. The appended claims in this invention generally should be construed to cover all such obvious forms and modifications which are within the true spirit and scope of the invention.

Having thus described the invention, what we claim is:

1. A method for supplying helium from at least one container to at least one end user comprising:

supplying helium from at least one container of helium to at least one end user through at least one supply system, measuring a pressure of the helium in the at least one supply system by at least one pressure transmitter, measuring an amount of helium dispensed from the at least one container and supplied to the at least one end user with a mass flow meter in electronic communication with a programmable logic controller, wherein the programmable logic controller is in electronic communication with the at least one pressure transmitter, providing a signal to the programmable logic controller of the amount of helium dispensed for providing a signal to the at least one end user of a residual amount of helium that remains in the at least one container, providing a pressurization gas system in electronic communication with the programmable logic controller, the pressurization gas system including additional helium gas provided from an external helium source other than the at least one container of helium, instructing the pressurization gas system with the programmable logic controller to feed the additional helium gas from the external helium source to the at least one container, thereby controlling a temperature of the at least one container, and measuring cumulative consumption of the additional helium gas used to pressurize the at least one container for determining the residual amount of helium that remains in the pressurization gas system for calculating in advance (i) a residual content of the external helium source and (ii) when a new external helium source must be installed without having to weigh the at least one container.

2. The method as claimed in claim 1 wherein the at least one end user is selected from the group consisting of air bag inflation, fiber optic production, chemical vapor deposition, mechanical surface coating, rocket purging and microelectronics wafer production, lifting applications, leak detection applications, welding applications, medical applications, and breathing applications.

3. The method as claimed in claim 1 wherein the at least one supply system comprises at least one pipe in communication with the at least one container and the at least one end user.

4. The method as claimed in claim 1 further comprising measuring a weight of the at least one container of helium before the supplying the helium.

5. The method as claimed in claim 1 wherein the mass flow meter measures a mass flow of the helium from the at least one container.

6. The method as claimed in claim 1 wherein the at least one supply system comprises an automatic process control valve.

7. The method as claimed in claim 1 further comprising measuring an initial weight of the at least one container and providing the initial weight to the programmable logic controller before the supplying the helium to the at least one end user.

8. The method as claimed in claim 1 further comprising an alarm which alerts the at least one end user that a pre-calculated value is exceeded in the at least one container.

9. The method as claimed in claim 8 wherein the pre-calculated value is selected from the group consisting of mass, temperature and pressure.

* * * * *